United States Patent [19]

Schönwald

[11] Patent Number: 4,492,530

[45] Date of Patent: Jan. 8, 1985

[54] COMPRESSOR UNIT

[75] Inventor: Siegfried Schönwald, Bad Neustadt, Fed. Rep. of Germany

[73] Assignee: Siemens Aktiengesellschaft, Berlin and Munich, Fed. Rep. of Germany

[21] Appl. No.: 379,444

[22] Filed: May 18, 1982

[30] Foreign Application Priority Data

May 25, 1981 [DE] Fed. Rep. of Germany ..... 3120730

[51] Int. Cl.[3] ..... F04B 35/04

[52] U.S. Cl. ..... 417/271

[58] Field of Search ..... 417/271, 273, 491, 498

[56] References Cited

U.S. PATENT DOCUMENTS

| | | | |
|---|---|---|---|
| 3,875,851 | 4/1975 | Foster | 91/498 |
| 3,934,967 | 1/1976 | Gannaway | 417/271 |
| 3,940,819 | 3/1976 | McMackin | 91/498 |
| 4,142,451 | 3/1979 | Burns | 91/491 |

FOREIGN PATENT DOCUMENTS

| | | | |
|---|---|---|---|
| 2832017 | 1/1980 | Fed. Rep. of Germany | 417/271 |
| 340263 | 12/1930 | United Kingdom | 91/498 |
| 753372 | 7/1956 | United Kingdom | 417/419 |
| 1566687 | 5/1980 | United Kingdom | 417/271 |

*Primary Examiner*—William L. Freeh

*Attorney, Agent, or Firm*—Kenyon and Kenyon

[57] ABSTRACT

Improvements in a compressor unit of the type which includes a radial piston compressor and a drive motor disposed in a housing about a stationary shaft are disclosed. The shaft is suspended from the housing by an elastic coupling to substantially suppress the transmission of vibrations and sound from the compressor unit to the housing. In a disclosed embodiment, the shaft is suspended by a rod-shaped elastic support member fastened to the housing and protruding into a cavity defined by a hollow portion of the shaft where the elastic member is connected to the shaft. According to one aspect of the invention, transmission of vibration and sound can be attenuated without the need to provide additional space by providing the unit's pressure outlet duct as the elastic support member.

3 Claims, 1 Drawing Figure

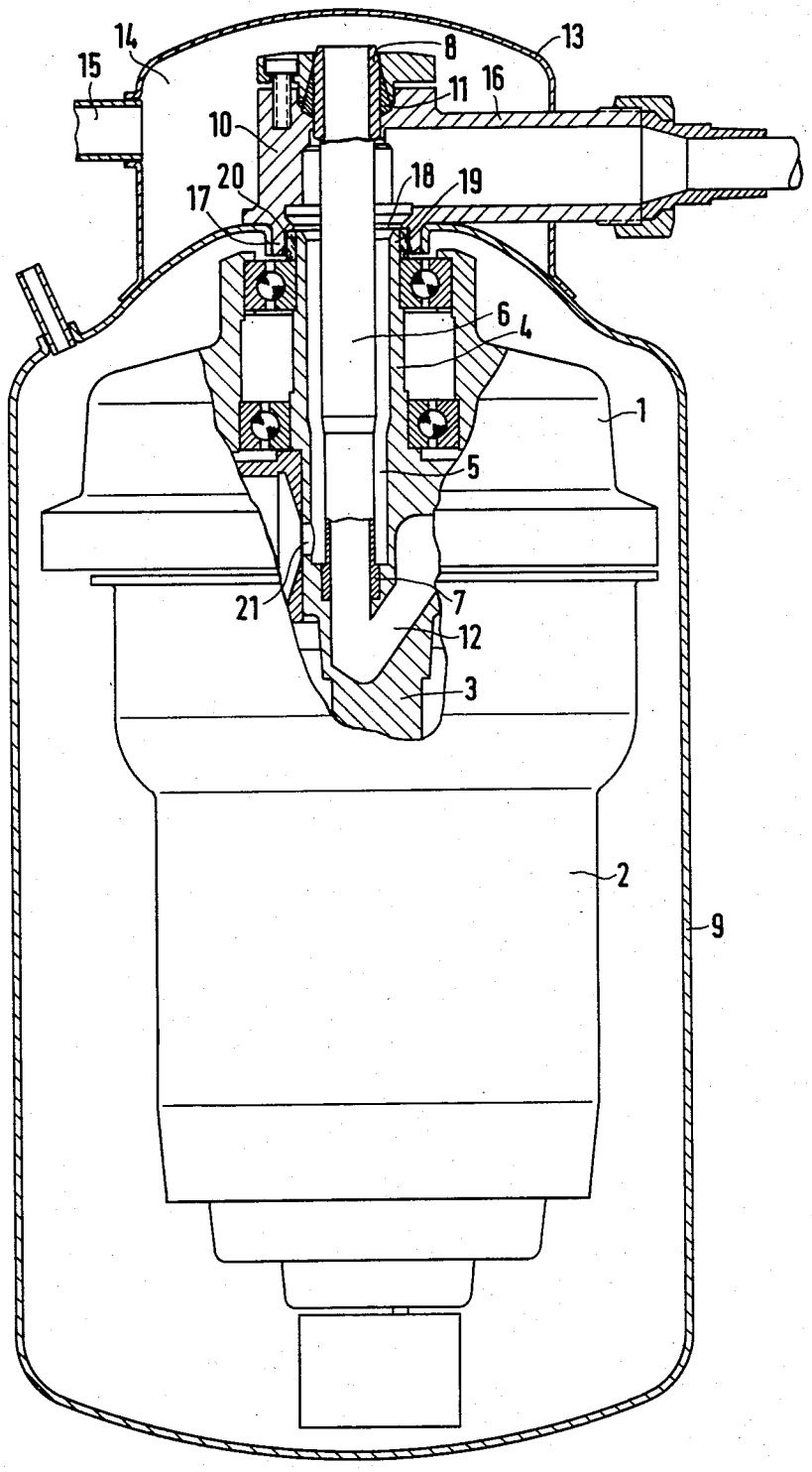
14
15
8
13
11
16
10
20
18
19
17
6
4
1
5
21
7
12
3
2
9

COMPRESSOR UNIT

BACKGROUND OF THE INVENTION

The present invention relates to a compressor unit of the radial piston compressor type.

British Patent Specification No. 1,566,687 discloses a radial piston type compressor unit in which the drive motor and the piston compressor are disposed about a stationary shaft which is rigidly suspended in the unit housing. As a result, vibrations and sound are transmitted unattenuated to the unit housing.

A compressor unit is also known which comprises an electric motor and a piston compressor in which the motor and the compressor are disposed about a stationary hollow shaft. For vibration damping, the shaft is movably supported at both ends in the unit housing by springs.

OBJECTS AND SUMMARY OF THE INVENTION

It is an object of the present invention to provide a compressor unit of the radial piston compressor type in which transmission of vibrations and sound to the unit housing is substantially suppressed.

It is also an object of the present invention to achieve the foregoing object without taking up additional space in the unit.

It is another object of the present invention to provide a compressor unit of the radial piston compressor type in which the space required for suspending the moving parts is reduced.

According to the invention, the above and other objects are achieved by elastically coupling the stationary shaft of a compressor unit of the radial piston compressor type to the unit housing. In accordance with the invention, the stationary shaft is supported from the housing by a flexible or elastic member.

According to a preferred embodiment, the stationary shaft is hollow on its side adjacent the piston compressor and defines a cavity thereat, and the flexible or elastic member is rod-like, and is connected at one end in the cavity to the shaft and at another end to the unit housing.

The elastic support member is operative to take up reaction acceleration moments as well as the weight of the piston compressor which occur when the compressor unit is started up and when it is running down upon being shut off. The elastic support member also allows the piston compressor to swing freely in the horizontal direction.

According to an aspect of the invention, the pressure outlet duct of the radial piston compressor can advantageously be provided as the support member in a compressor unit in which the shaft is made hollow on the side of the unit on which the compressor is disposed. The length and the cross section of the pressure outlet duct are selected to give the pressure outlet duct the elasticity required for free vibration. In this manner a separate support member and the space otherwise occupied by a separate member are not required.

The above and other objects, features, aspects and advantages of the invention will be more apparent from the following description of the preferred embodiments of the invention taken in conjunction with the accompanying drawing and appended claims.

BRIEF DESCRIPTION OF THE DRAWING

The present invention is illustrated by way of example and not limitation in the FIGURE of the accompanying drawing which is a side view partially in section of a compressor unit incorporating the principles of the present invention.

DESCRIPTION OF THE PREFERRED EMBODIMENTS

The embodiment of the compressor unit according to the invention illustrated in the drawing generally comprises a radial piston compressor 1 and a drive motor 2. A compressor unit of that general type is described in greater detail in British Patent Specification No. 1,566,687, which is hereby incorporated herein by reference.

The radial piston compressor 1 and the drive motor 2 are disposed about a common fixed shaft 3. The stationary shaft 3 is hollow at end 4 thereof adjacent the compressor side to provide a cavity or pressure space 5 therein. A pressure outlet duct 6 from the radial compressor is disposed in the cavity 5 of the shaft 3. One end 7 of the pressure outlet duct 6 in the cavity 5 is connected to the stationary shaft 3. The other end 8 of the pressure outlet duct 6 is fastened to a distribution head 10 which is disposed on the housing 9 of the unit. The distribution head 10 is fastened to the housing 9 by a press-fitted cone 11. The pressure outlet duct 6 is connected to the pressure slot of the radial piston compressor 1 by a canal 12 formed in the stationary shaft 3.

A cap 13 disposed on the unit housing 9 above the distribution head 10 forms a pressure chamber 14. The end 8 of the pressure outlet duct 6 opens into the pressure chamber 14. Compressed gas can be discharged from the unit through a pressure nozzle 15 provided in the cap 13. An inlet suction nozzle 16 is disposed at the distribution head 10 and is brought through the wall of the cap 13. On its side facing the housing 9, the distribution head 10 has a suction opening 18 which is surrounded by a circular flange 17. The stationary shaft 3 terminates in this suction opening 18. Between the circular flange 17 and the end 19 of the stationary shaft 3 are inserted seals 20. These seals seal the suction opening 18 from the interior of the housing 9 while permitting a rotary and swinging motion about the stationary shaft 3. Gas is drawn into the compressor through the cavity 5 which is in communication with the suction slot 21 of the radial piston compressor 1.

The pressure outlet duct 6 is elastic and its length and cross section are selected to permit horizontal vibrations of the compressor unit relative to the pressure inlet duct. The elasticity of the pressure inlet duct substantially attenuates the vibrations and sound transmitted to the housing 9.

A compressor unit without a centrally arranged pressure outlet duct can be provided with a separate rod-shaped support member which can be a tube, either hollow or solid.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. In a compressor unit comprising a housing, a radial piston compressor and a drive motor for the piston compressor, the piston compressor and the drive motor being disposed about and supported by a stationary shaft suspended in the unit housing, the improvement comprising the stationary shaft being hollow at its end adjacent the piston compressor and defining a cavity thereat, a flexible support member having one end protruding into said cavity connected to the shaft therein and another end fastened to the housing to flexibly couple the stationary shaft to the housing, the stationary shaft, and the piston compressor and the drive motor supported by the shaft, being arranged in the housing to swing freely therein upon flexing of the flexible support member.

2. The improvement according to claim 1 wherein the flexible support member is rod-like.

3. The improvement according to claim 2 wherein the compressor unit includes a pressure inlet duct which comprises the flexible support member.

* * * * *